United States Patent [19]

Rooney

[11] 4,359,612

[45] Nov. 16, 1982

[54] UNIVERSAL KEYBOARD AND METHOD OF PRODUCING SAME

[75] Inventor: Craig E. Rooney, Prairie Village, Kans.

[73] Assignee: Engineering Research Applications, Inc., Prairie Village, Kans.

[21] Appl. No.: 190,177

[22] Filed: Sep. 24, 1980

[51] Int. Cl.[3] ..... H01H 13/70; G08C 9/00; G06C 7/02

[52] U.S. Cl. ..... 200/5 R; 235/145 R; 340/365 R; 340/365 E; 400/472

[58] Field of Search ..... 200/1 R, 5 R, 5 A, 5 E, 200/17, 67 D, 67 DA, 67 DB, 159 B, 329, 330, 340; 400/187, 472, 477–479, 481, 495, 495.1; 340/365 R, 365 A, 365 E, 365 P, 365 S; 235/145 R; 84/DIG. 7

[56] References Cited

U.S. PATENT DOCUMENTS

| | | | |
|---|---|---|---|
| 2,891,649 | 6/1959 | Peterson | 400/187 |
| 2,978,086 | 4/1961 | Hickerson | 400/478 |
| 3,120,584 | 2/1964 | Grunfelder et al. | 200/5 |
| 3,353,038 | 11/1967 | Mason et al. . | |
| 3,725,908 | 4/1973 | Brisebarre | 340/365 A |
| 4,258,356 | 3/1981 | Jalbert | 340/365 R |

*Primary Examiner*—J. R. Scott

*Attorney, Agent, or Firm*—Schmidt, Johnson, Hovey & Williams

[57] ABSTRACT

An extremely low cost, high speed, full stroke keyboard is disclosed which provides momentary impulse operation. N-key rollover protection and standard tactile feedback. The keyboard includes a plurality of depressible keys mounted on respective upright synthetic resin flaps designed to collapse upon key depression and engage and move an underlying, resilient, U-shaped shifting member; the member in turn engages and shifts another U-shaped resilient element which supports one or more upstanding encoding posts. When the U-shaped element reaches a cocked position it is disengaged from the shifting member and allowed to snap back toward the original rest position thereof independently of subsequent return movement of the key and shifting member. The snap back motion is sensed and a corresponding key output signal developed.

28 Claims, 14 Drawing Figures

5.
5.

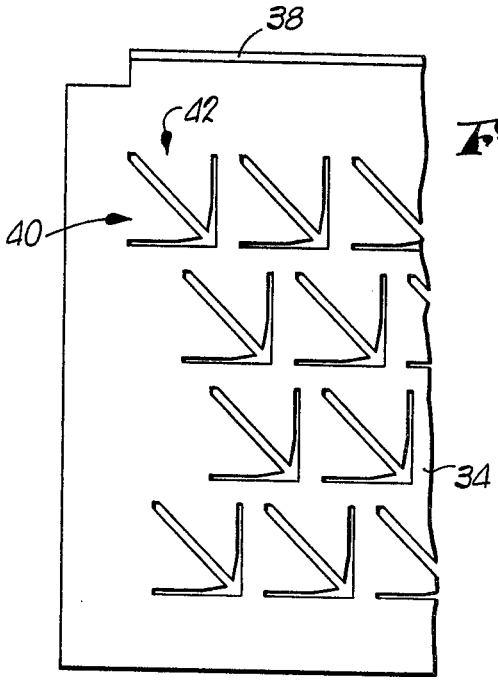
Fig.11.
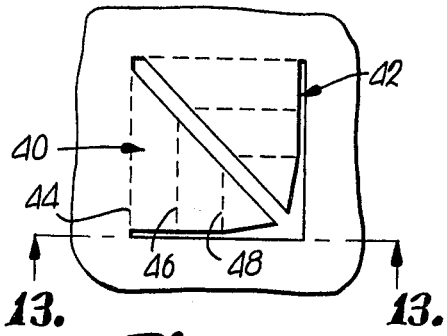
Fig.12.
Fig.13.
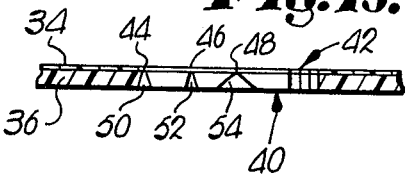
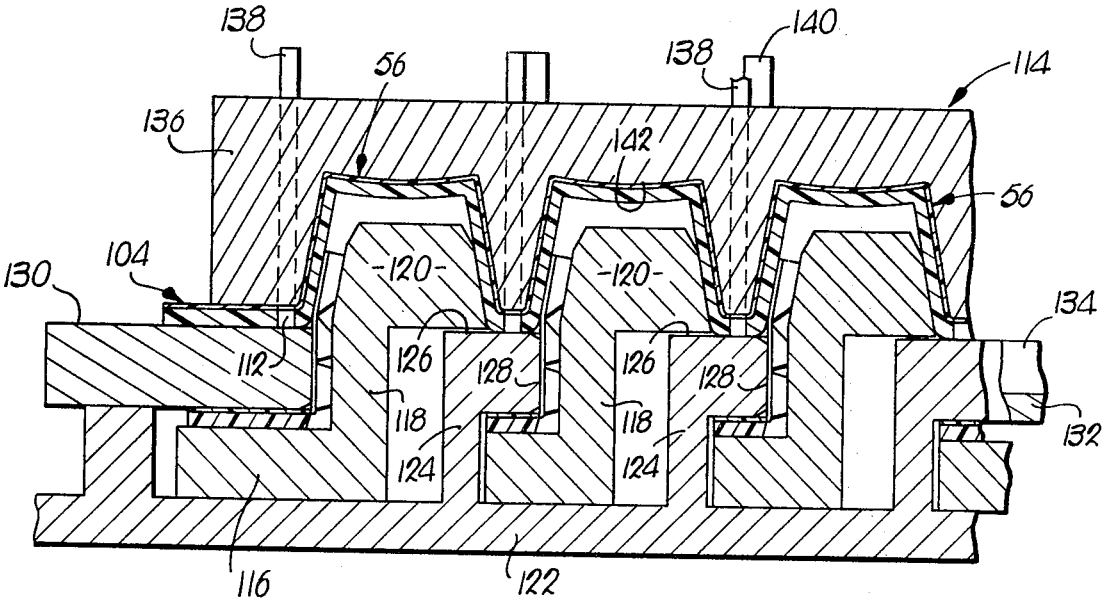
Fig.14.
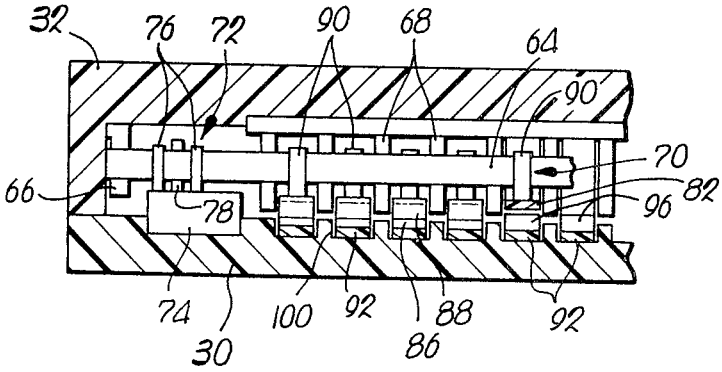
Fig.6.

UNIVERSAL KEYBOARD AND METHOD OF PRODUCING SAME

BACKGROUND OF THE INVENTION

1. Field of the Invention

The present invention relates to a greatly improved, low cost keyboard having the desirable features of conventional constructions, while at the same time having capabilities allowing use thereof in standard typewriters or input/output devices coupled to computers. More particularly, it is concerned with such a keyboard characterized by momentary impulse operation, N-key rollover protection, standard tactile feedback, reliability competitive with any known keyboard, and minimum possible thickness and cost. In another aspect, the invention is concerned with a greatly improved multiple key set or array, as well as a method of producing the same using only synthetic resin materials.

2. Description of the Prior Art

Keyboards are most commonly associated with typewriters and have until recent times developed in parallel with typewriter evolution. However, with the advent of the electronic age, a new generation of keyboards suitable for use as instruction keys for electronically activated devices has evolved. These keyboards have a wide array of uses, only one of which is to input electronic typewriters.

In the present state of the art, there are basically three types of keyboards. In one variety, electronic output in the form of electrically encoded signals to a companion or remote device is employed. In another type of keyboard, mechanical output movements are used which trip or activate leverages or linkages in either totally mechanical machines (e.g., manual typewriters) or electric machines such as electric typewriters. The principal distinguishing feature between these two types of keyboards is the form of output, i.e., mechanical movement or electric signal.

The third type of general keyboard construction can be thought of as a hybrid between the electronic and mechanical units. In this form, a mechanically induced movement is read electronically by one of various kinds of transducers, and the reader outputs the detected movement in the form of signals of an electronic nature.

While it is true that the keyboard art is old and well developed, the relatively recent proliferation of electronic devices that require operator instruction has caused the manufacturing of keyboards to grow at an enormous rate. Keyboards are required in all sizes, configurations, colors, shapes, tilts, slants, legends, codings, key strokes and depths. Despite this industry growth, or perhaps as a result thereof, no one keyboard or variety of keyboard has emerged as clearly superior. This is primarily due to the operational or cost limitations inherent in the various keyboard constructions, as well as the difficulty of modifying the same for particular purposes.

For example, in the case of full key stroke keyboards, the depth of the keyboard structure becomes a problem in many cases. The standard key switch plunger arrangement or mechanical leverage linkage consumes a considerable depth, because of the structural constraints encountered in developing a proper key stroke (approximately 3/16 of an inch) with acceptable key wiggle, direct depression travel, proper chassis and mounting cannister for either the key switch plunger or the leverage that attaches to the key stem. This in addition to the height of the key top itself necessitates a rather large, bulky overall keyboard structure. Because of the foregoing problems, full stroke keyboards are generally limited to conventional typewriters or input/output devices, and are not used on other types of equipment. Manifestly, the problem of providing a full stroke keyboard with minimum depth has limited the market potential of prior full stroke keyboards.

Virtually all known keyboards with key stroke capability require separate key tops. This is a fundamental requirement of the plunger or lever structure used as the key top support. The present industry standard for key tops on reliable equipment is double injection molded synthetic resin key tops. In this form, the key tops are first molded in one color of synthetic resin and an inner shell space is allowed for a second color injection that results in key legending being injected completely through the outer key shell. This process is inherently expensive in many ways. For example, it requires two complete injection runs for manufacture of the keyboard, using extremely expensive molding equipment which cannot be altered except at great expense. The double molding operation also results in a key top that is of substantial thickness and consumes a considerable amount of material.

The primary use of full stroke keyboards is in graphics and typewriting, including computer and CRT units. However, the bulk of the potential market for typewriter and printer equipment has grown accustomed to the tactile feel of conventional electric typewriters. These devices have feedback as a consequence of their design and mechanical construction. Tactile feedback in this context refers to a slight pressure increase required to depress a key through the initial range of key stroke, followed by a breakaway at about two-thirds of the stroke depth that is felt by the operator. This breakaway change from one pressure to a lighter pressure is not mimicked in any electronic keyboard in common usage, and accordingly this latter type of keyboard is deficient in this respect. In order to fully meet market demand and appeal to an already trained public, a keyboard form should include tactile feedback. Moreover, the amount of feedback should be variable without significant or costly manufacturing changes, in order to meet differing uses.

With touch typing at high speed on a conventional typewriter keyboard a phenomenon occurs which is referred to as "rollover." While typing at high speed, one key is in initial stages of depression before the priorly depressed key is released, and in some cases there could be as many as four keys simultaneously in various stages of depression, bottom out or upward travel. There are two ways to handle this problem that are in common use, i.e., mechanical blocking or filtering, or electronic scanning or logic analysis. Typical electric typewriters with keyboards use the technique of mechanical filtering. In this scheme some form of continuous chain of elements is configured in such a way that only one key lever at a time can pass through the chain. In this manner, no two keys can be in a position to interrupt or actuate a mechanical movement simultaneously. Because of the relatively high tolerance requirements of such systems, they are inherently expensive, can actually retard the speed of the typist, and present maintenance problems in that they can become gummed up and sticky over time. The typical electronic keyboard on the other hand solves the problem in an electronic way. Normally, a keyboard matrix of the key switch positions is scanned at high frequency. The first switch to be activated is entered into memory and the second switch is then entered while the output from the first switch is ignored or blocked and so forth until "N-keys" are depressed. For this reason electronic keyboards require a substantial amount of logic circuity, the relative amount and sophistication of the decoding and "N-key" analysis and speed of information scanning being in direct proportion to the cost of the board.

Another absolute necessity in connection with keyboards is that of reliability, i.e., the life or number of cycles which can be expected from the keyboard, and within a given number of cycles, the number of misses or fault signals that occur. The most expensive and reliable keyboards on the market today are so-called "Hall effect" keyboards. In these units key depression closes a switch which is magnetically sensed, and only a breakdown in the mechanics of the switch cannister or chassis can effect reliability of such a device. However, Hall effect keyboards are inherently very expensive by virtue of the many components required.

In short, it will be appreciated that the various keyboards of the prior art each possess a number of outstanding attributes, but all are plagued by one or more serious deficiencies. Accordingly, there is a real and heretofore unsatisfied need in the art for a simple, low cost keyboard having the combined properties of full stroke capability, tactile feedback, N-key roll-over protection, minimum depth, and a high degree of reliability.

SUMMARY OF THE INVENTION

The present invention in large measure solves the problems outlined above and provides a greatly improved keyboard which, in preferred forms, is manufactured almost entirely from low cost synthetic resin materials for ease of fabrication and cost reduction. The keyboard includes a plurality of separate, depressible keys, means for developing a keyboard output corresponding to depression of particular keys, and structure operably coupling the keys and the output means.

The coupling structure associated with the keyboard hereof preferably includes an elongated, resilient element associated with each key respectively along with means for shifting the element in response to depression of the associated key, and means for disengaging the element in its shifted condition and allowing the same to "snap back"" toward its original rest position independently of any subsequent movement of the key and related structure. The output means includes apparatus such as a microswitch which senses the shifting movement of the resilient element, and in this way develops an electric signal.

In the most preferred form of the invention, each key element is in the form of an elongated, resilient, U-shaped synthetic resin strip with an upstanding nib on one end thereof and with the other end being secured against translatory movement. A second elongated, resilient U-shaped member is disposed about the first strip and has a nib thereon for engaging the free end nib of the first strip, along with a key-engaging knee portion beneath the associated key. When the key is depressed, the second U-shaped element is pulled forwardly which in turn shifts the first U-shaped element in a similar direction by virtue of the engagement between the respective nibs. During such shifting, the potential energy level in the first resilient strip is increased until a cam-like disengaging surface forming a part of the keyboard structure is reached. At this point the surface is engaged, the nibs are separated, and the first U-shaped element is allowed to "snap back" toward its original position.

One or more upstanding encoding posts are carried by the first U-shaped strip and, during the "snap back" sequence, these posts engage one or more corresponding, transversely extending, synthetic resin encoding strips in order to flex the latter. Such flexure in turn moves respective upright arms operatively engaged by the encoding strips, and such arm movement is sensed or read in order to develop the keyboard output signal.

The preferred key array in accordance with the present invention is formed of synthetic resin material and includes an integral synthetic resin base sheet cut to present a plurality of upstanding, individual flaps, with respective key tops secured to the flaps. Lines of weakness are formed in the key-supporting flaps such that, when a downwardly directed force is applied to the keys, the supporting flaps collapse downwardly. Upon release of the key, the resilience of the flaps, along with the resilience of the underlying shifting strip, cooperatively return the key to its normal rest position. Preferably, the lines of weakness in the respective flaps are formed so that, upon depression of the keys, the associated flaps form operating projections which engage the knee portions of the associated underlying shifting elements for moving the latter.

BRIEF DESCRIPTION OF THE DRAWINGS

FIG. 6 is a sectional view taken along line 6—6 of FIG. 1;

FIG. 11 is a fragmentary top view illustrating a die cut base sheet used in the fabrication of the key set;

FIG. 12 is an enlarged, fragmentary view of a pair of adjacent key top-supporting flaps, with the lines of weakness of the respective flaps being illustrated in phantom;

FIG. 13 is a sectional view taken along line 13—13 of FIG. 12 which further illustrates the flap construction; and FIG. 14 is a schematic view illustrating the connection of the respective key top-supporting flaps and the preformed key top structures.

DESCRIPTION OF THE PREFERRED EMBODIMENT

Figure 1:
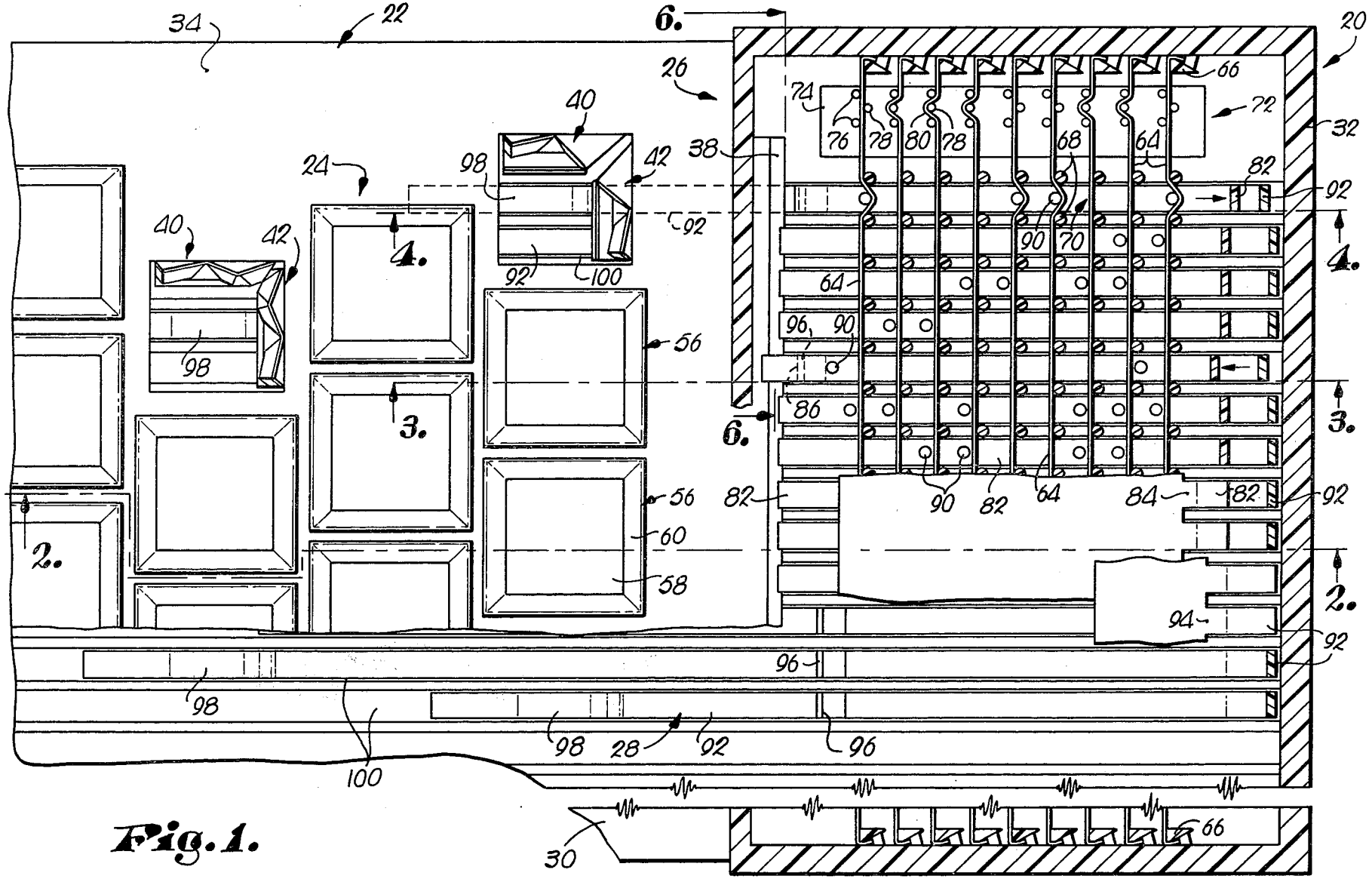
FIG. 1 is a fragmentary top view partially in section and with parts broken away illustrating a keyboard in accordance with the present invention.

Turning now to the drawings, a keyboard 20 in accordance with the invention is illustrated in FIG. 1. Broadly speaking, the keyboard 20 includes a set 22 of individual, depressible keys 24, output means 26 for developing a keyboard output corresponding to the depression of particular keys 24, and structure referred to by the numeral 28 for operably coupling the keys 24 and the output means 26. A support assembly including a base member 30 and a housing 32 also forms a part of the overall keyboard 20.

Figures 2, 3, 4, 5:
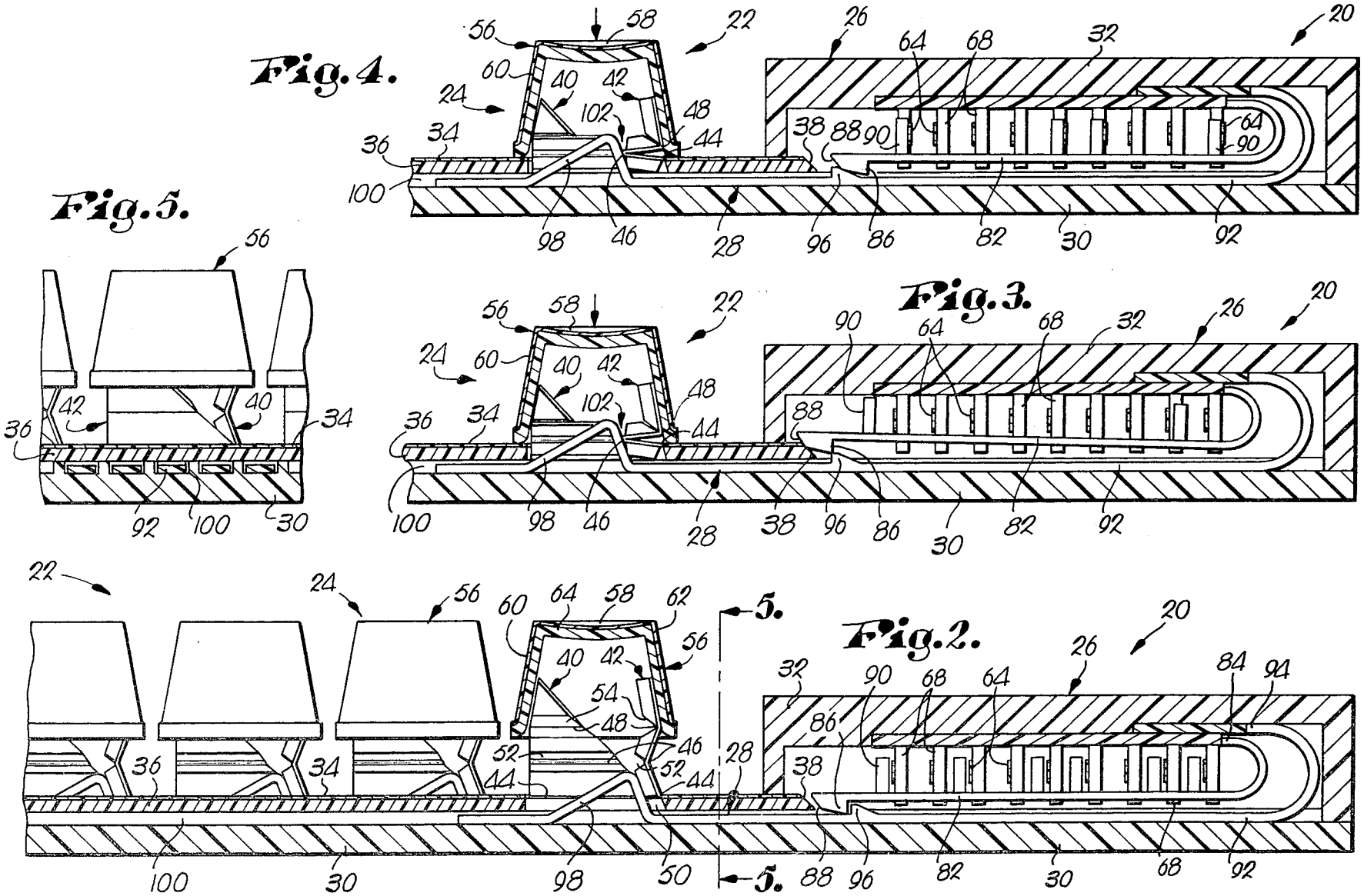
FIG. 2 is a sectional view taken along line 2—2 of FIG. 1 which illustrates the configuration of the keyboard and the internal operating components thereof.
FIG. 3 is a sectional view taken along line 3—3 of FIG. 1 and depicts the operation of the keyboard when an individual key is depressed.
FIG. 4 is a sectional view taken along line 4—4 of FIG. 1 which illustrates the momentary impulse "snap back" operation of the keyboard.
FIG. 5 is a vertical sectional view taken along line 5—5 of FIG. 2.

Key set 22 includes an integral synthetic resin base sheet 34 formed of a suitable tough, resilient material such as one of the well known polycarbonate resins. The sheet 34 is backed by a layer 36 of structural backing material such as a high density polyethylene. As best seen in FIG. 2, the sheet 34 and layer 36 are supported atop base member 30; moreover, the rearward end of the sheet and layer are disposed within housing 32, and the extreme rearmost edge is beveled as at 38. The importance of this beveled surface, which extends the full width of the sheet and layer at the rearward end thereof, will be explained hereinafter.

A plurality of respective pairs of upright, somewhat triangularly shaped flaps 40, 42 are cut from the sheet 34 and layer 36, as best seen in FIG. 2. Preferably, the flaps are at right angles to one another. In addition, each of the flaps is configured to present a total of three vertically spaced, transversely extending lines of weakness 44, 46 and 48 therein, such that the lines present in effect fold or hinge lines across the body of each of the flaps 40, 42. It will also be observed that the layer 36 is cut at the region of the lines 44–48 to present respective, transversely extending, triangular in cross section relieved areas or recesses 50, 52 and 54.

A separate key top 56 is secured to each respective pair of upright flaps 40, 42. Each key top 56 includes an uppermost, concave finger depression top wall 58, as well as a depending continuous sidewall 60 so that the key top presents an open-bottom, hollow configuration. Each of the key tops is formed from synthetic resin material identical with that of the base member, i.e., an outermost integral sheet 62 of polycarbonate material backed with a layer 64 of a high density polyethylene.

Again referring to FIG. 2, it will be seen that each of the key tops 56 is adhesively secured to the uppermost triangular portions of the flaps 40, 42. Further, and as will be explained in detail hereinafter, each of the flaps are configured for collapsing downwardly when a downwardly directed force is applied to the associated key top in order to effect depression of the key; in addition, the nature of the materials used in the flaps 40, 42, as well as the configuration thereof, helps to return the key to its upright position illustrated in FIG. 2, when the key is released.

The keyboard output device 26 is disposed within housing 32 and includes a plurality of elongated, resilient, spaced apart encoding strips 64 which are respectively secured to the sidewalls of housing 32 by appropriate connectors 66. Each of the strips 64 is slightly longer than the distance between the points of connection thereof, and the importance of this feature will be made clear hereinafter. In the embodiment illustrated, a total of nine separate encoding strips 64 are depicted (eight information bit strips, and one parity coding strip). In preferred forms, the strips would be formed of a suitable synthetic resin material such as mylar.

A plurality of laterally spaced, encoding strip-engaging pegs 68 depend from the top wall of the housing 32. As best seen in FIG. 1, the pegs 68 are arranged in respective, spaced apart pairs, the spacing between individual pegs of each pair defining an engagement and flexure region 70 for the adjacent encoding strip 64. The number of regions 70 along the length of each encoding strip is equal to the number of keys in the key set 22.

A sensing apparatus 72 is also provided within housing 32 and forms a part of the overall keyboard output device. The sensing apparatus in the illustrative form depicted includes a microswitch assembly 74 having a total of nine separate microswitches, one for each of the encoding strips 64. A pair of spaced apart upright stabilizers 76 are provided for engaging each transversely extending strip 64, and a switch arm 78 forming a part of the microswitch associated with the particular encoding strip 64 is located between the adjacent stabilizers 76. In the rest or null signal position of the strips 64, the slack or extra length of the strip referred to above is taken up at the region of the associated stabilizers and switch arm. That is to say, in their rest positions the strips are drawn taut by being threaded between the corresponding stabilizers and switch arms, and short, arcuate sections 80 are drawn in the strips between the stabilizer pairs.

The coupling structure 28 includes, for each key 24, a first, elongated, resilient U-shaped element 82 having one end 84 thereof secured to the top wall of housing 32. The free end of element 82 is configured to present a downwardly extending nib 86, and a forwardmost beveled surface 88. The element 82 is preferably formed of mylar or other suitable synthetic resin material having good resilience qualities, and supports a number (even or odd depending upon the coding system employed) of upstanding strip-engaging and flexing posts 90, such posts forming a part of the overall encoding device. In the rest position of the elements 82, the posts 90 are located between respective strips 64 (see FIG. 1) but are closer to the rearmost adjacent strip.

A second U-shaped resilient synthetic resin member or element 92 is also provided for each key, and serves as a means for shifting of the associated element 82 in a manner to be described. Each element 92 is disposed about the corresponding element 82 and includes an end 94 secured above the end 84 of element 82 (see FIG. 2). An upstanding nib 96 is provided on the element 94 and is located for interengaging with nib 86 of element 82. The forward or free end of each element 92 extends beneath the associated key 24. At the region of key 24, an upstanding knee portion 98, somewhat in the form of an inverted "V", is provided which extends into the aperture in the base sheet presented by the upstanding integral flaps 40, 42. Referring to FIG. 6, it will be seen that the base member 30 is configured to present respective elongated channels 100 which receive and guide the elements 92 during axial shifting thereof.

The operation of keyboard 20 can best be understood from a consideration of FIGS. 2–4. FIG. 2 illustrates the keyboard with certain of its keys in the rest positions thereof, i.e., not depressed. In this orientation, it will be seen that the nibs 86, 96 are adjacent each other, and that knee portion 98 extends up and has the rearward leg thereof adjacent the lowermost portion of flap 42 between the lines of weakness 44, 46.

When a downwardly directed force is applied to top wall 58 of a selected key 24, the following occurs. First, the respective flaps 40, 42 collapse upon themselves as viewed in FIG. 3, this being permitted by virtue of the orientation of the lines of weakness 44, 46 and 48, as well as the recesses 50, 52 and 54. As a result of such collapsing movement of the flap 42, an operating projection 102 is formed, made up of the portions of the flap 42 between the lines 44, 46 and 48. As the flap 42 collapses and forms the projection 102, the adjacent leg of knee portion 98 is engaged with the effect that the lowermost portion of the element 92 is shifted forwardly, or leftwardly as viewed in FIG. 3. During such movement, the engagement between the nibs 96, 86, causes the element 82 to likewise be pulled forwardly or leftwardly. By virtue of the resilient nature of the element 82, such physical translatory movement of the free end of the element in effect serves to deform the element and increase the potential energy thereof. The nib 86 and free end of the element 80 are drawn forwardly until the surface 88 comes into contact with the beveled surface 38. At this point the camming action developed between the surfaces 38, 88, serves to separate or disengage the nibs 86, 96. As a consequence of this disengagement, the element 82 quickly "snaps back" in a rightward direction as viewed in FIG. 4 to a point where the posts 90 carried by the element momentarily engage and flex the associated encoding strips 64. During such "snap back" motion, the strip 82 travels at a speed which is orders of magnitude greater than the speed of travel of the key during depression thereof, and the overtravel of the strip past its neutral or rest position creates the mechanical signal through flexure of the strips 64. Because of the nature of the strip 82, and the cocking and disengaging thereof as explained, the total length of time involved in engaging and flexing the associated strips 64 is quite small, and the actual effective signal duration developed at the end of strip flexure is in the range of microseconds. It will be appreciated that the very high return speed of travel of the strip 82, and the extremely short signal duration, are developed using only the force derived directly from manual depression of the associated key; no motors or the like are employed.

Further, the disengagement of the nibs 86, 96 gives a positive tactile feedback at the key 24. Upon such disengagement, the pressure required to further depress the key is lessened, thereby giving an indication that the keying operation is completed.

Each of the strips 64 engaged and flexed by the posts 90 creates a corresponding output signal through the microswitch assembly 74. Specifically, the flexing of the respective strips pulls the associated arcuate region 80 thereof taut, with the effect that the engaged switch arm 78 is shifted slightly and actuated. This in turn creates an output signal at the microswitch, and the totality of signals from the assembly 74 for each key depression can be read and processed using conventional electronic circuitry (not shown) for this purpose. It will be understood in this respect that an individual pattern of engagement between the posts and strips will be provided for each key 24, so that a unique overall output signal will be developed for each key.

When the depressed key 24 is released, the flaps 40, 42 and the element 92 cooperatively serve to raise the key top back to its original starting position. Thus, the element 92 shifts rightwardly as viewed in FIGS. 2–4 back to the original rest position thereof, and serves, with the assistance of the resilient flaps 40, 42, to quickly elevate the key. It will be observed in this respect that depression of a selected key 24 serves to develop an output signal corresponding to the letter or symbol of the key, and that only a single, momentary impulse is developed, which cannot be repeated until the key is released and redepressed. Specifically, when the element 82 is cocked and released and the impulse delivered to the appropriate strips 64, the element 92 cannot return to its original starting position until the key is released. These operational characteristics give the keyboard 20 a high degree of N-key rollover protection. This results from the fact that the output-creating movements being read are momentary, small, impulse movements that can occur only once per key depression. Because of the microsecond period during which the signals are developed in the present keyboard, it is highly unlikely from a statistical standpoint that the operator will create overlapping output signals.

Figure 7:
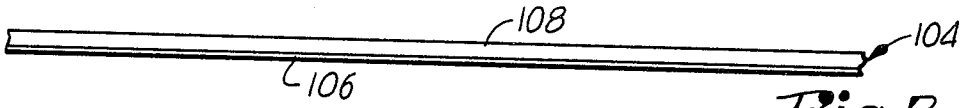
FIG. 7 is a fragmentary side elevational view illustrating a laminated synthetic resin sheet used in forming the key tops of the keyboard structure.
Figure 8:
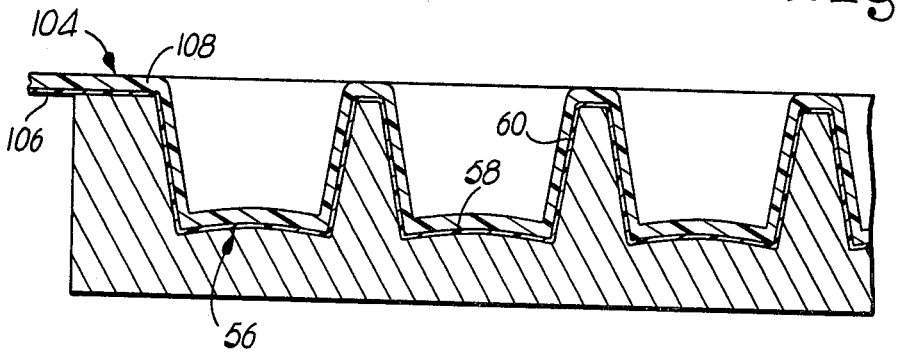
FIG. 8 is a schematic view illustrating the first vacuum forming operation in the fabrication of the key top structure.
Figure 9:
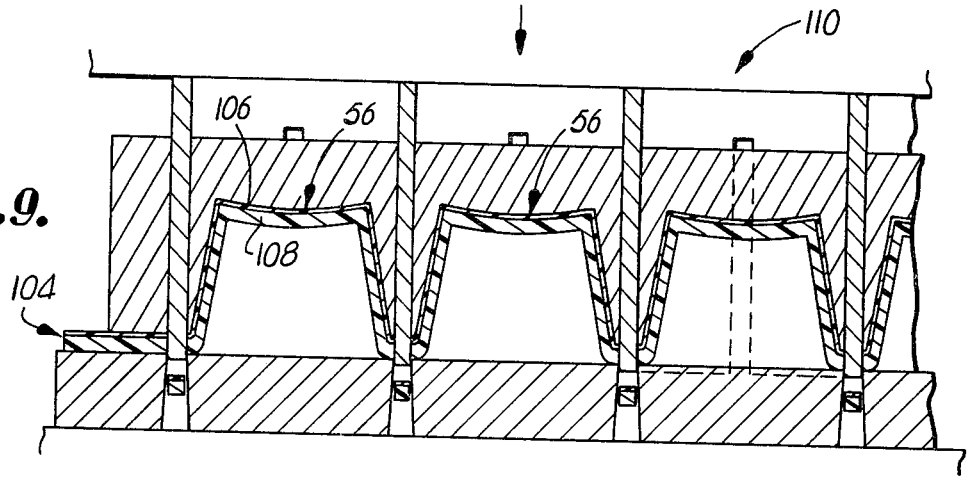
FIG. 9 is a schematic view illustrating another step in the production of the key top structures wherein the formed key tops are partially die cut.
Figure 10:
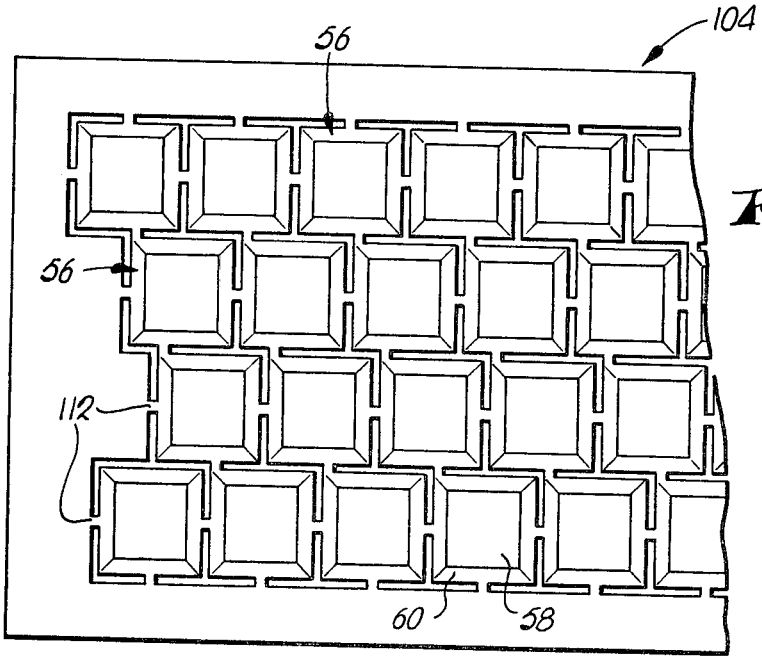
FIG. 10 is a fragmentary view of the formed, partially die cut key top sheet.

Attention is next directed to FIGS. 7–14, which illustrate the preferred manner of construction of the key set 22. As illustrated in FIG. 7, the key top structure is fabricated from a starting sheet 104 made up of an integral, thin polycarbonate sheet 106 laminated to a relatively thick, high density polyethylene backing 108. In this regard, a particular feature of the preferred method is that the sheet 106 can be back printed with desired letters, numbers or other symbols prior to lamination with the backing 108. This gives virtually unlimited flexibility in producing the key top structure at minimum cost, inasmuch as the use of costly and difficult to modify injection molds is completely eliminated. Further, because the marking of the key structures is achieved through a simple printing or photographic process, any color or style of letter or the like can be employed.

The next step involved in the key top manufacture involves molding of the laminated sheet 104 to present the key top structures in a desired pattern, i.e., with concave top walls 58, and continuous sidewalls 60. This can be accomplished in any known manner, such as by the vacuum forming procedure schematically illustrated in FIG. 8.

The next step involves die cutting of the formed sheet to substantially separate each of the hollow, open-bottom key top structures 56 from the starting sheet 104. This is done using a conventional die cutting apparatus 110 for this purpose, with blades designed to essentially separate each key top from the sheet 104, while leaving small connection regions 112 in each case.

The base member forming a part of the key set 22 is initially formed separately from the key top sheet. Referring to FIG. 11, it will be seen that the laminate made up of the base sheet 34 and backing layer 36 is first die cut to present respective flaps 40, 42, and to cut the beveled rearward edge 38. It will be noted in this respect that in plan configuration the flaps are substantially triangular in shape.

In the next step the respective lines of weakness 44, 46 and 48 are made in the sheet, along with the recesses 50, 52 and 54 (see FIG. 13). (If desired, the recesses can be molded into the starting sheet).

In the final step of key set manufacture, the flaps 40, 42 are adhesively secured to the inner surfaces of the depending sidewalls of corresponding key tops 56. During the final connection of these components, the key tops 56 are completely separated from one another by severance of the regions 112, so that the key tops are independent of one another and operatively secured to the underlying flaps 40, 42. An exemplary connection apparatus 114 is illustrated in FIG. 14.

The apparatus 114 includes a first sheet-supporting plate 116 having a series (one for each key of the ultimate set) of upstanding elements 118 terminating in uppermost, tapered, key-supporting blocks 120. The apparatus also includes a second plate 122 having a series of upstanding, spaced apart, somewhat inverted L-shaped members 124 presenting an uppermost horizontal die surface 126 and a vertical flap engaging face 128. The overall apparatus further includes a plate 130 having a series of elongated, spaced apart fingers or bars 132. Each of the bars 132 presents a recess 134 along the length thereof, and, as will be explained, serves as a tab punch die during use of apparatus 114. Finally, the overall apparatus has a cooperating upper member 136 which receives the preformed key top structures and allows seating thereof against the upper margins of the respective flap pairs. The upper member 136 carries a series of tab punches 138 and 140, and is formed along the underside thereof to present a series of key-receiving recesses 142.

In the use of apparatus 114, the plate 130 is removed, along with upper member 136, and secondary plate 122 is shifted leftwardly from its FIG. 14 position to a point where the upright lateral faces of adjacent elements 118 and L-shaped members 124 are in contact. At this point the base sheet depicted in FIG. 11 is placed on the horizontally extending stretches of the members 116, with the respective flap pairs extending upwardly in engagement with orthogonal faces of the upright portions of the members. In the next step, the secondary plate 122 is shifted rightwardly to its FIG. 14 position, such that the faces 128 of the member 124 engage one of the flaps of each flap pair and press the same firmly against the corresponding elements 118. The multiple-bar plate 130 is next passed over the base sheet and between key rows such that the side faces of the bars engage adjacent upright flaps and press the latter against the proximal face of the elements 118. At this point, by virtue of the faces 128 of the members 124, as well as the bars 132, both flaps of each respective flap pair are securely held in place against a corresponding element 118. Note in this respect that the uppermost triangular portions of the respective flaps extend above the upper surface of the plte 130.

In the next operational step, glue is applied to the outer surfaces of the flap upper margins, and the preformed sheet 104, located in conforming relationship within the upper member 136, is placed atop the plate 130 with each recessed key top structure receiving a corresponding tapered block 120 (see FIG. 14). An adhesive connection is thus formed between the upper triangular portions of each flap pair and an associated key top.

The shiftable tab punches 138, 140 are next separated to sever the respective key tops from the remainder of the sheet 104, so that each key top is independently connected to a separate flap pair. The apparatus 114 is then disassembled, and the resultant key top structure removed.

It will be apparent to those skilled in the art that the keyboard structure of the present invention possesses a number of advantages not heretofore available in any single unit. For example, the disclosed keyboard has minimum depth which is in effect the sum of the chassis thickness and the desired key stroke. The upper extent of the key tops can occur at a point just above the key stroke minimum or it may be at whatever height is desired for a given application. This minimum depth with full key stroke capability is in itself a considerable advantage. At the same time however, the structure of the key set with upstanding flaps gives the individual keys good stability in torsion with relative flexibility in folding or collapsing such that when depressed the keys will travel in a stable and essentially linear path without unacceptable side sway or wiggle. This is true even if the key is depressed off center or at an angle to its designed line of depression travel. Further, these results are accomplished in an inexpensive, easily manufactured construction.

The key top structure is also highly advantageous in that it is not limited either by the cost complexity of present key tops, or in the color, shape or indicia desired thereon. In sharp contrast to prior key sets, the present construction can be made at a fraction of the cost and in a form that is ideally suited for mechanized, high volume fabrication.

As noted above, tactile feedback is inherent in the present keyboard design. Further, the amount of feedback can be increased or lessened as desired through the simple expedient of employing materials of different resilience for the U-shaped elements.

It will also be observed that N-key and rollover filtering is handled mechanically by virtue of the momentary impulse characteristic of the output device of the invention. Such relatively minor mechanical movements at the encoding strips require neither circuitry, circuit boards or special and elaborate logic systems. Additionally, the elimination of circuit boards and complex wiring normally associated with key switches further reduces the basic cost of the keyboard, and allows for a wide variety of key encoding and key top positions with minimal tooling investments. It is believed that no prior keyboard has ever been devised that mechanically creates a direct momentary impulse movement which is rollover and N-key protected. Further, it is believed that it is novel to accomplish these functions with structure which at the same time provides tactile feedback.

The present keyboard serves to encode impulse mechanical movements at the coding chamber where a matrix exists which can be quickly modified and adjusted to produce any desired encoding at the key without expensive retooling. This is to be contrasted with typical keyboards which are coded either mechanically or electrically. In either case, the coding is done once for any given keyboard and is thereafter limited to the mechanical hardware or encoder circuitry selected.

Typical mechanical encoding through coding bars not only limits the quickness of response (by virtue of the mass of the code bars), but also fixes the code to a given mechanical form (tooling limits) and is subject to false output from anomalies in vibration from the keyboard. The penchant of certain known typewriters to automatically type a hyphen symbol if the keys are vibrated in a certain way is the result of this phenomenon. The flexible encoding strips of the present keyboard allow for extremely rapid impulse movements and response, but because of the very low mass of the synthetic resin encoding strips, vibration phenomena are all but eliminated.

In the keyboard of the invention, the ends of the encoding strips are read or sensed. This reading is of a small mechanical movement caused by the flexure of the strips as described. It will be apparent in this regard that virtually any reliable form of sensing small momentary movement can be used, including direct mechanical actuation from the encoding strip. Hence, the present keyboard can be linked up to a strictly mechanical or electric device for reading purposes. By way of example, photoelectric, Hall effect, capacitance, contact or strain sensors can be employed. Further, a number of readers or sensors required is limited to the number of encoding strips, and unlike electronic keyboards a key switch or reader is not required at each key. Because of this, high quality reading or sensing can be provided at very low cost. Finally, due to the flexure movement employed, there are virtually no parts to wear out or become fouled. It is believed that the present keyboard has less maintenance and wear problems than the typical key switch assembly of an electronic keyboard, and far less than that of a typical lever keyboard.

All of the above factors ultimately relate to the reliability of the present keyboard. The reliability of any keyboard that is equipped with quality readers or sensors is limited basically by the useful life of the relevant mechanics, and the latter is closely related to stresses, tolerances, and number of required parts. By virtue of the very simple design and low number of parts, the keyboard hereof can be manufactured to meet or exceed the reliability and useful life of any known keyboard, and at a significantly lower cost.

Having thus described the invention, what is claimed as new and desired to be secured by Letters Patent is:

1. A keyboard, comprising:

a plurality of separate, depressible keys;

means for developing a keyboard output corresponding to the depressing of particular keys; and structure associated with each of said keys respectively for operably coupling the associated keys and said output means, including a first, elongated, resilient, U-shaped element having a nib adjacent the free end thereof and the other end thereof secured against translatory movement;

a second, elongated, resilient, U-shaped element disposed about said first element and having a key-engaging portion beneath the associated key, a nib thereon for engaging the nib of said first element when the first and second elements are in the rest positions thereof, with the end of said second element adjacent said other end of the first element being secured against translatory movement, said key-engaging portion being configured for, when the associated key is depressed, shifting said nib of the second element in a direction away from the secured ends of the elements such that the nib of the first element is engaged to simultaneously translate and deform the free end of the first element in the same direction; and a cam surface located for engagement by said nibs during said translation thereof for disengaging the nibs and permitting said first element to return to the rest position thereof, said output means including structure for sensing the return movement of said first element back to said rest position thereof, and means operably coupled with said sensing structure for generating an electrical output signal corresponding to said sensing of return movement.

2. The keyboard as set forth in claim 1, said associated key and said key-engaging portion being cooperatively configured for permitting return movement of said second element to the rest position thereof upon release of the key after said depression thereof.

3. A keyboard, comprising:

a plurality of separate, depressible keys;

means mounting said keys for individual, selective movement thereof through respective keystroke distances;

a resilient element associated with each key respectively;

means shiftably mounting each of said elements proximal to the corresponding key, with the elements each having and being biased toward a rest position;

shifting means operably coupled with each key for engaging and shifting the associated element against said bias and during said movement through the respective keystroke distance;

disengaging means for each key for disengaging said associated element from said shifting means prior to completion of said movement of the corresponding key through the respective keystroke distance, in order that said associated element will commence return movement back toward said rest position before the corresponding key travels the full keystroke distance, and such that said associated element will overtravel the rest position thereof before returning to its rest position; and means for sensing said overtravel shifting of said elements, and for generating electrical output signals corresponding to said sensing, including a plurality of selectively actuatable devices for generating electrical signals; and means operably coupling each of said elements, upon said overtravel shifting thereof, with at least one of said signal-generating devices for actuation of the latter, at least certain of said elements being operably coupled, upon said overtravel shifting thereof, with respective, different pluralities of said first-mentioned plurality of signal-generating devices, whereby respectively distinguishable electrical signals will be generated for each key upon depression thereof.

4. The keyboard as set forth in claim 3, said element comprising a first elongated strip of resilient material having a first nib thereon, said shifting means comprising a second elongated strip adjacent said first strip and having a second nib thereon, said first and second nibs being in engagement when said first strip is in said rest position thereof.

5. The keyboard as set forth in claim 4, said disengaging means comprising a cam surface oriented for engagement by said nibs during said shifting thereof for separating said nibs and allowing said back shifting of said element.

6. The keyboard as set forth in claim 3, said output means including at least one upstanding post on said element, and an encoding strip which is engaged by said post upon said back shifting of said element.

7. The keyboard as set forth in claim 3, said signal-generating devices comprising a plurality of individual, selectively actuatable switches, and said coupling means comprising an elongated encoding strip operably coupled with each individual switch respectively for operating the switch when the corresponding strip is engaged, and means mounting said strips for engagement thereof by said elements during said return movement of the elements.

8. The keyboard as set forth in claim 3, said coupling means including structure for actuating the corresponding signal-generating devices upon momentary impact of the coupling means, each of said elements being configured and arranged for momentary impact engagement with one or more of said coupling means during said overtravel shifting of the element.

9. The keyboard as set forth in claim 3, said elements, in said rest positions thereof, are spaced from the corresponding signal-generating devices.

10. The keyboard as set forth in claim 3, wherein at least some of said signal-generating devices form a part of more than one of said respective, different pluralities.

11. A keyboard, comprising:

a plurality of separately, manually depressible keys;

a resilient element associated with each key respectively;

means shiftably mounting each of said elements proximal to the corresponding key, with the elements each having a rest position;

shifting means operably coupled with each key for shifting the associated element in a first direction in response to manual depression of the corresponding key and using only the force developed through said manual depression thereof;

means for disengaging each of said elements from the corresponding shifting means therefor during said manual depression of the corresponding key, for permitting the disengaged element to freely travel in a second direction opposite said first direction to an extent that the disengaged element overtravels said rest position thereof before returning to its rest position, the speed of travel of each element in said second direction being substantially in excess of the speed of travel of the corresponding keys during said depression thereof;

means for sensing said overtravel shifting of said elements, and for generating electrical output signals corresponding to the sensing of said overtravel shifting of said elements, including a plurality of selectively actuatable devices for generating electrical signals;

means for operably coupling each of said elements, upon said overtravel shifting thereof, with at least one of said signal-generating devices for actuation of the latter, at least certain of said elements being operably coupled, upon said overtravel shifting thereof, with respective different pluralities of said first-mentioned plurality of signal-generating devices, whereby respectively distinguishable electrical signals will be generated for each key upon depression thereof.

12. The keyboard as set forth in claim 11, said signal-generating devices comprising a plurality of individual, selectively actuatable switches, said coupling means comprising an elongated encoding strip operably coupled with each switch respectively for operating the switch when the corresponding strip is engaged, and means mounting said strips for engagement thereof by said elements during said overtravel shifting of the elements.

13. The keyboard as set forth in claim 11, said coupling means including structure for actuating the corresponding signal-generating devices upon momentary impact of the coupling means, each of said elements being configured and arranged for momentary impact engagement with one or more of said coupling means during said overtravel shifting of the element.

14. The keyboard as set forth in claim 11, said elements, in said rest positions thereof, are spaced from the corresponding signal-generating devices.

15. The keyboard as set forth in claim 11, wherein at least some of said signal-generating devices form a part of more than one of said respective, different pluralities.

16. A keyboard, comprising:

a plurality of separate, depressible keys;

an elongated, resilient, deformable element associated with each key respectively;

means mounting each of said elements proximal to the corresponding key, each of said elements having a rest position configuration;

means operably associated with each key for deforming and thereby increasing the potential energy of the associated element, in response to depression of the corresponding key, and for thereafter releasing the deformed, associated element and allowing the same to move and expend said increased potential energy, said movement including overtravel shifting of the element past said rest position thereof; and means for sensing said overtravel shifting of said elements, and for generating electrical output signals corresponding to said sensing, including a plurality of selectively actuatable devices for generating electrical signals;

means for operably coupling each of said elements, upon said overtravel shifting thereof, with at least one of said signal-generating devices for actuation of the latter, at least certain of said elements being operably coupled, upon said overtravel shifting thereof, with respective, different pluralities of said first-mentioned plurality of signal-generating devices, whereby respectively distinguishable electrical signals will be generated for each key upon depression thereof.

17. The keyboard as set forth in claim 16, said elements being formed of synthetic resin material.

18. The keyboard as set forth in claim 16, said signal-generating devices comprising a plurality of individual, selectively actuatable switches, said coupling means comprising an elongated encoding strip operably coupled with each switch respectively for operating the switch when the corresponding strip is engaged, and means mounting said strips for engagement thereof by said elements during said movement of the elements.

19. The keyboard as set forth in claim 16, said coupling means including structure for actuating the corresponding signal-generating devices upon momentary impact of the coupling means, each of said elements being configured and arranged for momentary impact engagement with one or more of said coupling means during said overtravel shifting of the element.

20. The keyboard as set forth in claim 16, said elements, in said rest positions thereof, are spaced from the corresponding signal-generating devices.

21. The keyboard as set forth in claim 16, wherein at least some of said signal-generating devices form a part of more than one of said respective, different pluralities.

22. A keyboard output device for use with a keyboard having a plurality of individual, manually depressible keys for developing a momentary output corresponding to the depression of particular keys and comprising:

a plurality of elongated, resilient spaced apart encoding strips;

linkage means operatively coupled with each key for, upon depression of the key, momentarily engaging and flexing one or more of said strips in a predetermined individual pattern for each key, the linkage means coupled with at least certain of said keys being disposed for momentarily engaging and flexing a plurality of said strips, the duration of engagement time between said one or more strips and said linkage means for each key being independent of the duration of manual depression of the key; and means for sensing the momentary engagement and flexure of said encoding strips, and for generating corresponding electrical output signals.

23. The device as set forth in claim 22, said linkage means comprising one or more strip-engaging posts, there being means operatively coupling said one or more posts and the key associated therewith for shifting of said one or more posts in response to depression of the key.

24. The device as set forth in claim 22, including means for preventing a recurrence of the operation of said linkage means for each key until the respective key is released and redepressed.

25. The device as set forth in claim 22, said linkage means comprising:

an elongated, shiftable element for each key respectively and including strip-engaging structure carried thereby; and shifting means operably coupling each key and its respective element for shifting of the element in response to depression of the key, and for causing said structure carried thereby to engage and flex said one or more strips.

26. The device as set forth in claim 22, each of said elements being formed of resilient material, said shifting means including means for shifting each element upon depression of the associated key to increase the potential energy of the element, and for thereafter releasing the element to allow the element to move.

27. The device as set forth in claim 22, said sensing and signal generating means including:

individual electrical switching means operably coupled to each encoding strip respectively and having structure for actuation thereof when the coupled strip is engaged by said linkage means.

28. The device as set forth in claim 27, said electrical switching means comprising individual electrical switches.

* * * * *